United States Patent [19]

Ohashi

[11] Patent Number: 4,704,663

[45] Date of Patent: Nov. 3, 1987

[54] PORTABLE LIGHTING ARRANGEMENT

[75] Inventor: Keiichi Ohashi, Shizuoka, Japan

[73] Assignee: Skylite Industry Co., Ltd., Shizuoka, Japan

[21] Appl. No.: 885,721

[22] Filed: Jul. 15, 1986

[30] Foreign Application Priority Data

Dec. 2, 1985 [JP] Japan ..... 60-271141

[51] Int. Cl.[4] ..... F21L 7/00

[52] U.S. Cl. ..... 362/206; 362/202

[58] Field of Search ..... 362/189, 157, 202–206, 362/197, 194, 208

[56] References Cited

U.S. PATENT DOCUMENTS

| | | | |
|---|---|---|---|
| 1,334,835 | 3/1920 | Bryant | 362/206 |
| 2,225,936 | 12/1940 | Williams | 362/206 |
| 2,256,641 | 9/1941 | Fullmer | 362/206 |
| 2,677,022 | 4/1954 | Fleming | 362/206 |
| 4,195,329 | 3/1980 | Woog | 362/206 |
| 4,443,833 | 4/1984 | Fazzina | 362/204 |

*Primary Examiner*—James C. Yeung

*Attorney, Agent, or Firm*—Wegner & Bretschneider

[57] ABSTRACT

A portable lighting arrangement includes a case formed of a plastic material, a cap having therein a reflector and an electric bulb and attached detachably and water-tightly to an opening in said case, a battery holder adapted to detachably mount therein a plurality of dry batteries through said opening along the outer surface thereof, a pair of connecting pieces provided at the front end of said holder, a pair of contacts provided at the rear end of said holder, and a switch attached water-tightly to the rear end of said case.

2 Claims, 13 Drawing Figures

PORTABLE LIGHTING ARRANGEMENT

FIELD OF THE INVENTION

Figure 1:
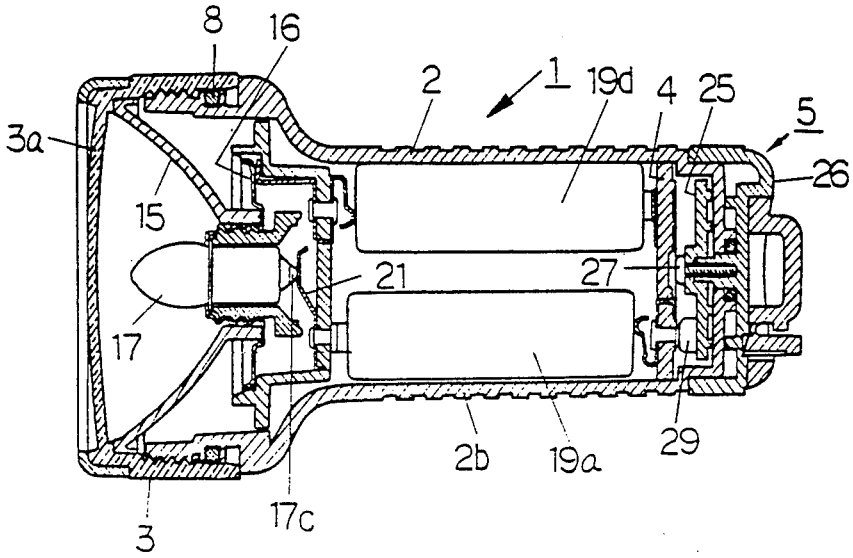

The present invention generally relates to portable lighting arrangement such as flashlights and, more particularly, to portable lighting arrangement including a dry battery holder in a case.

BACKGROUND OF THE INVENTION

Heretofore, there have been well-known portable lighting arrangement which includes a battery holder removably inserted into a case, a dry battery accommodated in that holder, a bulb connected with a front end of the holder, and a switch provided at a rear end of the holder. An example of such arrangement is disclosed in Japanese Utility Model Publication No. 52-17992.

In the prior art lighting arrangement of such a type, however, since electrical and mechanical connections are made between the dry battery and the bulb with the use of inner and outer coils, the structure therefore is complicated. In addition, the replacement 6 of either dry battery or bulb always needs simultaneous removal of both, so that there is a fear that the bulb may be damaged. Since the switch is of the structure that opening or closing of contacts is achieved by sliding movement of a switch piece, it is not easy to make the overall arrangement waterproof. Thus, there is a problem that no satisfactory waterproofing effect is obtained.

SUMMARY OF THE INVENTION

It is therefore a main object of the present invention to provide a portable lightening arrangement wherein the structures for making connections between a plurality of dry batteries and connecting them to an electrical bulb are so simplified that the replacement of either bulb or dry batteries is made possible, and satisfactory waterproofing effect is attained through a relatively simple mechanism.

According to the present invention, the aforesaid object is achieved by the provision of a portable lighting arrangement which includes:

a case formed of a plastic material and being open at least on the front end, a cap having therein a reflector and an electric bulb and attached detachably and watertightly to an opening in said case, a battery holder adapted to detachably mount therein a plurality of dry batteries through said opening along the outer surface thereof, said batteries being connected in series with each other, a pair of connecting pieces provided at the front end of said holder for making connections between said bulb and both terminals of said pair of dry batteries, a pair of contacts provided at the rear end of said holder and drawn out of both terminals of the intermediate portion of said batteries, a switch attached watertightly to the rear end of said case for closing or opening of sid pair of contacts by axial turning of said switch, thus all being made in a simplified structure to an efficient watertightness, wherein connection between dry batteries and the replacement thereof are made easy when the battery houses dry batteries, replacement of either bulb or dry batteries alone is made possible by combining a bulb into a cap, and the dry battery holder can be detachably mounted into the case by means of the axially turnable switch.

BRIEF DESCRIPTION OF THE ACCOMPANYING DRAWINGS

Figure 2:
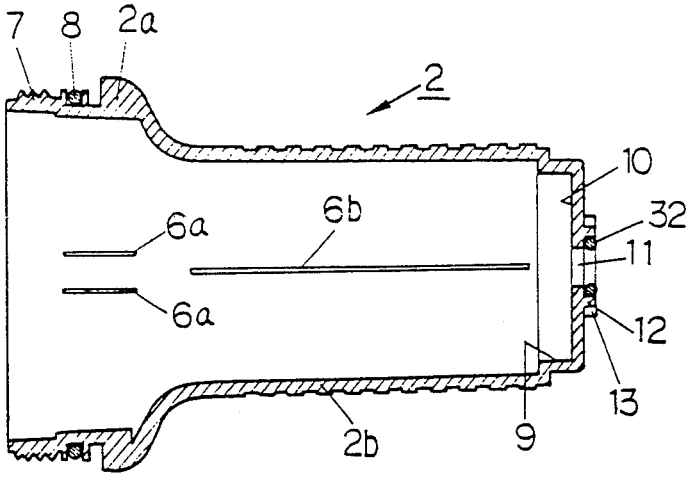
Figure 3:
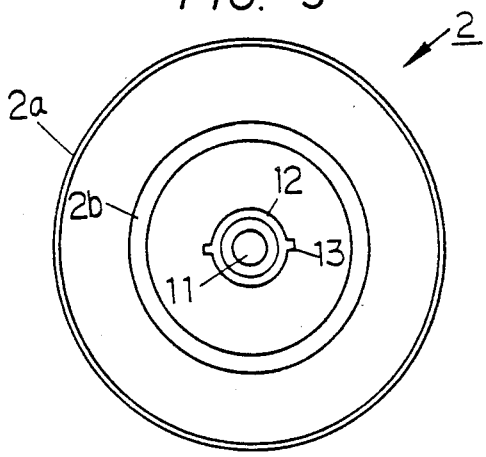
Figure 4:
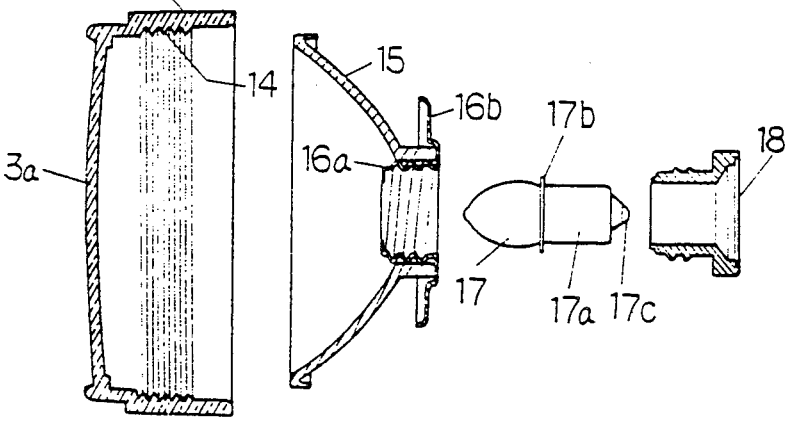
Figure 5:
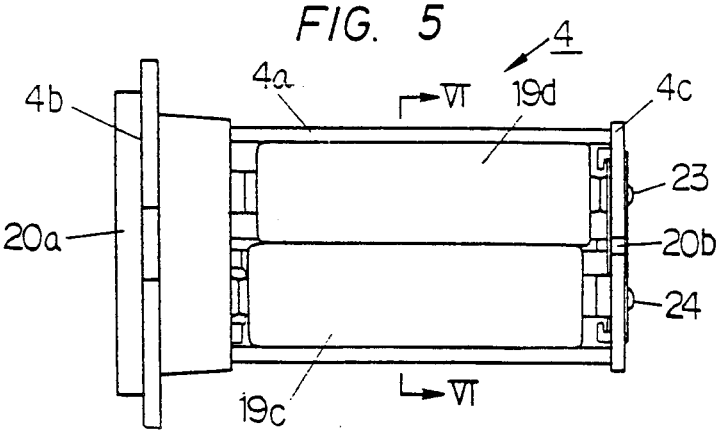
Figure 6:
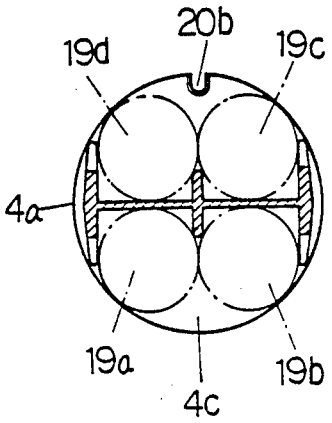
Figure 7:
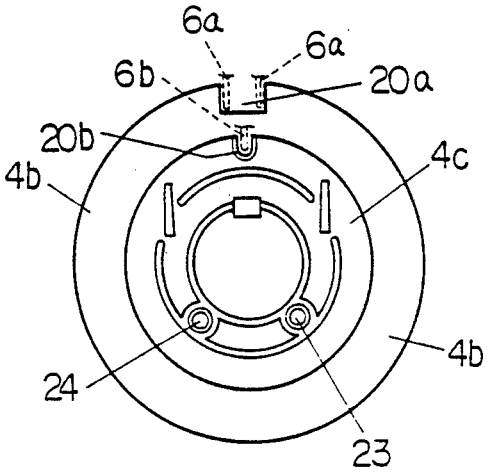
Figure 8:
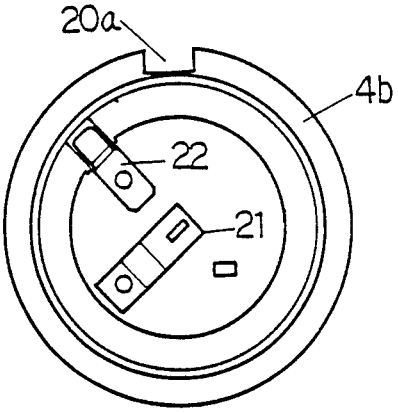
Figure 9:
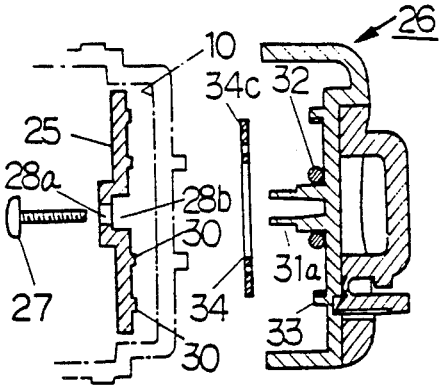
Figure 10:
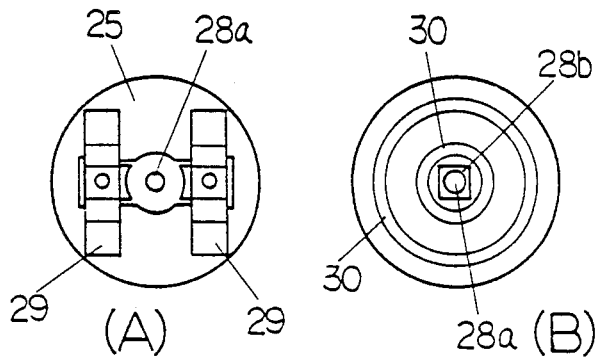
Figure 11:
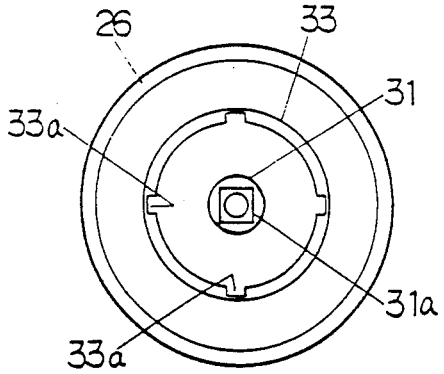
Figure 12:
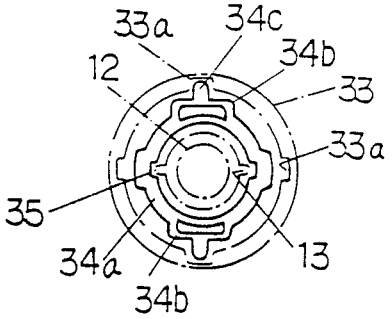

For a better understanding of the invention and showing how the same may be carried into effect, reference will now be made, by way of examples, to the accompanying drawings, in which:

FIG. 1 is a sectional view illustrating one embodiment of the lighting arrangement according to the present invention, FIG. 2 is a sectional view showing a case, FIG. 3 is a right-side view of FIG. 2, FIG. 4 is an exploded sectional view of a cap portion, FIG. 5 is a plan view showing a battery holder, FIG. 6 is a sectional view taken along the line VI—VI of FIG. 5, FIG. 7 is a right-side view of FIG. 5, FIG. 8 is a left-side view of FIG. 5, FIG. 9 is an exploded sectional view of a switch, FIG. 10*a* is a left-side view showing a contact member shown in FIG. 9, FIG. 10*b* is a right-side view of that contact member, FIG. 11 is a left-side view showing an operable member shown in FIG. 9, and FIG. 12 is a view showing the details of a spring member.

PREFERRED EMBODIMENTS OF THE INVENTION

Referring now to FIG. 1 showing one embodiment of the portable lighting arrangement according to the present invention, a portable lighting arrangement generally shown at 1 includes a case 2, a cap 3 to be attached to an opening in the front end of the case, a battery holder 4 housed within the case 2, and a switch 5 assembled to the rear end portion of the case 2.

As illustrated in FIGS. 2 and 3, the case 2 is in the form of a bottomed cylinder having a front end portion 2*a* of a larger diameter and a rear portion 2*b* of a smaller diameter, and being open in the front end. It is noted that the case 2 is integrally formed of a plastic meterial.

As can clearly be seen from FIG. 2, the portions 2*a* and 2*b* of larger and smaller diameters are provided on the inner surfaces with projecting pieces 6*a* and 6*b*, which engage the battery holder 4 inserted into the case 2 to prevent any axial turning thereof. As illustrated in FIG. 2 and described later, the portion 2*a* of a larger diameter is provided on the outer surface with an externally threaded section 7 for the insertion of the cap 3 and an O-ring 8 for providing sealing with respect to the cap 3. As will be understood from FIGS. 2 and 3, the rear end of the portion 2*b* is of a further smaller diameter, and is provided with an inner step 9 adapted to abut against the rear end portion of the battery holder 4 so as to inhibit any more insertion of the holder 4.

The portion 2*b* of a smaller diameter includes a bottom plate member 10, in the center of which there is bored at 11, as shown in FIGS. 2 and 3. The bottom plate 10 is also provided on the outer surface with a ring projection 12 having an inner diameter larger than that of the hole 11, and two projections 13, which are arranged diametrically with respect to the ring projection 12, said projections being all integrally formed, so as to allow assembling of the switch 5.

As shown in FIG. 4, the cap 3 is integrally formed, e.g. of a transparent plastic material together with a front protective plate 3a, is provided on the inner surface with an internally threaded section 14 for engagement with the externally threaded section 7 on the case 2. The cap 3 also includes therein a reflector 15.

The reflector 15 is, as shown in FIG. 4, integrally provided at the middle portion of the back surface side with an internally threaded member 16 of a metallic material, which has an inner flange portion 16a at the front end and a collar portion 16b at the rear end. As illustrated in FIGS. 1 and 4, the member 16 is designed to receive detachably a light bulb 17 via a mounting member 18.

More specifically, the electric bulb 17 includes a base 17a which has a collar portion 17b at the front end, as can be appreciated from FIG. 4. The collar portion 17b may be fixedly clamped between the inner flange portion 16a and the mounting member 18, which may be in the form of a cylindrical member of a plastic material, for instance, by engaging the mounting member 18 with the internally threaded member 16 in a state where the base 17a is inserted in the mounting member 18.

In this manner, the bulb 17 is fixed within the internally threaded member 16 with the base 17a being electrically connected to the collar portion 16b. Thus, the bulb 17 is put on by connecting both terminals of the batteries to a central terminal 17c (see FIG. 4) thereof and the collar portion 16b.

On the other hand, the battery holder 4 is comprised of a body 4a adapted to detachably receive four dry batteries 19a, 19b, 19c and 19d of, e.g. size D from the outside, a front end portion 4b which is generally in the form of a hat, and a rear end portion 4c which is in the form of a disk, as shown in FIGS. 1, 5 and 6. As illustrated in FIGS. 5 or 8, the front and rear end portions 4b and 4c are provided in the outer surfaces with notches 20a and 20b which are designed to receive the projecting pieces 6a and 6b, when the holder 4 is inserted in the case 2 from the front opening, whereby any turning of the holder 4 within the case 2 is prevented. The disengagement of the batteries 19a–19d from the body 4a is then achieved with the inner surface of the cylindrical portion 2b of a smaller diameter of the case 2, as illustraed in FIG. 1. Within the body 4a of the holder 4, four dry batteries 19a, 19b, 19c and 19d are connected in series with each other. As illustrated in FIGS. 1 and 8, the plus terminal of the front battery 19a is connected to the connecting piece 21 assembled within the front end portion 4b so as to bring it in contact with the central terminal 17c of the bulb 17, while the minus terminal of the rear battery 19d is connected to the other connecting piece 22 assembled with the front end portion 4b so as to bring it in contact with the collar portion 16b of the internally threaded member 16. As illustrated in FIGS. 1, 5 and 7, the minus terminal of the front battery 19a is connected to the contact 23 fixedly inserted through the rear end portion 4c of the holder, while the plus terminal of the battery 19b to be connected in series with the battery 19a is connected to the contact 24 fixedly inserted through the rear end portion 4c.

Both contacts 23 and 24 are mounted at 6 the rear end portion 4c at an angle of turning of, e.g. 90° , as illustrated in FIG. 7. Both contacts 23 and 24 are closed by turning of the switch 5, whereby four batteries 19a–19d are connected in series to the bulb 17 for putting-on.

As illustrated in FIGS. 1 and 9, the switch 5 includes a contact member 25 fixedly incorporated within the case 2, and an operable member 26 capped over the outer surface of the rear end of the case 2. Both members 25 and 26 are connected to each other by means of one screw 27.

As can clearly be seen from FIGS. 9 and 10a, 10b, the contact member 25 is formed into a disk, in the center of which there are a screw hole 28a and a rectangular hole 28b. On the side of the member 25 in opposition to the battery holder 4 there are two connecting piates 29 for connecting both contacts 23 and 24 together, whereby putting-on or -off is repeated for each 90° -axial turning of the contact member 25. As illustrated in FIGS. 9 and 10b, on the surface of the contact member 25 in opposition to the bottom plate 10, two convex rings 30 are integrally provided to reduce the amount of contact resistance with respect to the bottom plate 10.

As will be appreciated from FIGS. 9 and 11, the operable member 26 is in the form of a cap fitted over the rear end portion of the case 2, and includes in the center thereof a carrying shaft 31 having at one end a rectangular shaft portion 31a to be fitted into the rectangular hole 28b. Then, the contact member 25 is integrally connected to the operable member 26 by the threaded insertion of the screw 27 into the carrying shaft 31 in a state where the rectangular shaft portion 31a is fitted into the rectangular hole 28b. As illustrated in FIGS. 1 and 9, the carrying shaft 31 is provided with an O-ring 32, which is designed to be located inside of the ring projection 12, when the operable member 26 is attached to the bottom plate 10. The O-ring 32 provides sealing between the operable member 26 and the bottom plate 10 for relative turning.

As shown in FIGS. 9 and 11, a ring-like projection 33 having four recessions 33a at equal intervals in disposed around the carrying shaft 31 arranged within the operable member 26. A spring member 34 is installed inside of the ring-like projection 33 so as to temporarily fix the operable member 26 in place, whenever it turns through an angle of 90°.

As illustrated in FIG. 12, the spring member 34 includes a ring portion 34a having two recessions 35 on its inside and two projections 34c attached to the outside of the ring portion 34a through a gate-like spring portion 34b. As can be seen from FIG. 3, the projection 13 on the outside of the bottom plate 10 is fitted into the recessions 35 to fix the spring member 34 and the bottom plate 10 against axial rotation.

As illustrated in FIG. 12, the projections 34c are locked into the recessions 33a in the ring-like projections 33. The operable member 26 is turned with a force larger than a certain force to yield the spring portion 34b and move the projections 34c toward the axial center, whereby the projections 34c are disengaged from the recessions 33a to release the temporary fixation thereof. The operable member 26 is then turned through an angle of 90° for the projections 34c to be engaged again with other recessions 33a for fitting, whereby the operable member 26 is temporarily fixed in the turning direction.

The arrangement as mentioned above operates as follows.

For use, the operable member 26 is turned in either one or reverse direction. Thereupon, either one of the connecting plates 29 makes connection between both contacts 23 and 24, and the projections 34c of the spring member 34 are fitted into the recessions 33a in the ring-like projection 33, whereby the operable member 26 is restrained temporarily from rotating around the axis.

When both contacts 23 and 24 are connected to each other by means of the connection plate 29, four batteries 19*a*, 19*b*, 19*c* and 19*d* contained in the associated holder 4 are connected in series with the bulb 17 for lighting on.

When the operable member 26 is turned through an angle of further 90°, the projections 34*c* of the spring member 34 are fitted into other recessions 33*a* in the ring-like projection 33 to temporarily restrain the operable member 26 from rotating around the axis. However, since no connection is made between both contacts 23 and 24 by any one of the connecting plates 29, the switch 5 is held off.

When the operable member 26 is turned through an angle of still further 90°, connection is again made between both contacts 23 and 24 by either one of the connecting plates 29, whereby the switch 5 is put on. In this manner, putting-on and -off of the switch 5 are repeated for each 90° turning of the operable member 26, and the operable member 26 is restrained temporarily from rotating around the axis whenever the switch 5 is held on and off.

On the other hand, since the switch 5 is a so-called rotary switch of the rotary system, the use of only an O-ring assures a simple and reliable waterproof structure, unlike a switch of the sliding reciprocation type. The switch 5 is easy to assemble, since it is assembled by means of a single screw 27. In addition, the switch 5 maintains its original function made available when assembled, since it is not necessary to remove it at the time of replacement of dry batteries or bulb, as will be described later. The replacement of batteries or bulb is achieved by removing the cap 3 from the case 2 to provide openingof the end of the case 2.

For the replacement of batteries, the battery holder 4 is pulled form within the case 2 for the removal of dry batteries 19*a*–19*d*. In this case, the replacement of batteries is very simple, since the batteries 19*a*–19*d* can be removed out side the body 4*a*. Even with such an arrangement, there is no fear of disengagement of batteries, since the batteries 19*a*–19*d* are held in place on the inside of the cylindrical portion 2*b* of a smaller diameter.

After the replacement of batteries has been finished, the battery holder 4 is inserted into the case 2. In this instance, the holder 4 is unequivocally positioned against axial turning by the engagement of the projecting pieces 6*a*, 6*b* on the inner face of the case 2 within the notches 20*a*, 20*b* in the holder 4, so that there is neither fear that both contacts 23 and 24 may displace relative to the connecting plate 29, nor disadvantage that the battery holder 4 may turn with turning of the operable member 26. Since the holder 4 is located in the case 2 by allowing it against the inner step 9 of the case 2, there is no fear that the connecting plates 29 may be damaged upon receiving impacts at the time of insertion.

For the replacement of an electric bulb, the cap 3 is removed from the case 2, followed by the removal of the mounting member 18 from the internally threaded member 16. Thereupon, the bulb 17 is simultaneously removed. A new bulb is then attached to the reflector 15 with the use of the mounting member 18. Thereafter, the cap 3 is attached to the case 2.

Thus, since the present invention is of the structure that the holder 4 having therein the dry batteries 19*a*–19*d* being inserted in the case 2, it is possible to make connection between the batteries 19*a*–19*d* outside the case 2 in such simplified structure. With the arrangement wherein the bulb 19 is incorporated into the cap 3, it is possible to effect replacement of the bulb or batteries alone. In addition, it is further possible to simplify the structure for the connection of the batteries 19*a*–19*d* with the bulb 17. The structure is also simplified, since sealing between the cap 3 and the case 2 is provided by the use of a single O-ring.

While the foregoing embodiment has been described as using four batteries which are connected in series, it is understood that two sets of batteries, each comprising two batteries connected in series, are juxtaposed.

With the arrangement as mentioned above, wherein the holder having therein a plurality of batteries is disposed within the associated case, it is easy to make connection between the respective batteries. The attachment or detachment of the respective batteries is carried out outside the holder, so that the replacement of batteries is easy.

Since the bulb is incorporated into the cap, it is possible to replace the bulb or batteries alone and, in particular, to prevent the bulb from being damaged.

The use of a switch of the rotary system assures a simple and reliable waterproof structure. In addition, the design that the holder can be removed from the case through its end opening eliminates the need of removing the switch at the time of replacement of batteries and serves to maintain its original function made available when assembled.

What is claimed is:

1. A portable (lightening) lighting arrangement which includes:

(A) a case having a longitudinal axis and a front and rear end formed of a plastic material and being open at least on the front end;

(B) a cap having therein a reflector and an electric bulb and attached detachably and watertightly to an opening in said case;

(C) a battery holder having a front and rear end adapted to detachably mount therein a plurality of dry batteries and removably received in said case through said opening, said plurality of dry batteries being connected in series with each other from a front battery to a rear battery;

(D) a pair of connecting pieces provided at the front end of said holder for making connection between said bulb and two of said dry batteries;

(E) a pair of contacts provided at the rear end of said holder one each connected to said front battery and said rear battery; and (F) a switch means comprising a contact member incorporated within said case and connected with an operable member capped over said rear end of said case, said switch means attached watertightly to the rear end of said case so as to be rotatable about the axis of said case for closing or opening of said pair of contacts by axial turning of said switch.

2. The arrangement as defined in claim 1, wherein said battery holder is held in said case and restrained against axial turning by allowing it to abut against the inner face of said case.

* * * * *